United States Patent [19]

Dude

[11] 4,033,290

[45] July 5, 1977

[54] APPARATUS FOR COATING SHEET MATERIAL

[75] Inventor: Henry Albert Dude, Rochester, N.Y.

[73] Assignee: Eastman Kodak Company, Rochester, N.Y.

[22] Filed: Mar. 23, 1976

[21] Appl. No.: 669,556

[52] U.S. Cl. ..... 118/266

[51] Int. Cl.[2] ..... B05C 11/00

[58] Field of Search ..... 118/264, 265, 266, 268

[56] References Cited

UNITED STATES PATENTS

| | | | |
|---|---|---|---|
| 443,781 | 12/1890 | Moore | 118/268 |
| 1,769,250 | 7/1930 | Arvidson | 118/266 |
| 2,348,067 | 5/1944 | Hoitt | 118/264 X |
| 3,157,536 | 11/1964 | Caines | 118/266 X |
| 3,678,848 | 7/1972 | Roser et al. | 118/264 X |
| 3,749,049 | 7/1973 | Schultz | 118/264 X |

*Primary Examiner*—James Kee Chi

*Attorney, Agent, or Firm*—A. P. Lorenzo

[57] ABSTRACT

Apparatus for coating sheet material with liquid coating compositions is comprised of a reservoir, an absorption wick which receives liquid from the reservoir and provides an arcuate surface, and a transfer wick in conforming contact with the arcuate surface of the absorption wick. The transfer wick is fixedly secured at one end thereof and free at the opposite end to move toward or away from the absorption wick. Sheet material to be coated, for example a continuous web or a series of discrete sheets conveyed in succession to a coating station, is advanced across and in contact with the free end of the transfer wick to pick up a layer of coating composition.

17 Claims, 7 Drawing Figures

APPARATUS FOR COATING SHEET MATERIAL

BACKGROUND OF THE INVENTION

1. Field of the Invention

This invention relates in general to the art of coating and in particular to wick-type coating apparatus for use with liquid coating compositions. More specifically, this invention relates to a novel coating apparatus which functions by the principle of wicking and is especially advantageous for use in the coating of discrete sheets of material but can also be used in the coating of continuous webs.

2. Description of the Prior Art

In wick-type coating apparatus, the wick can be used to transfer the coating composition to the peripheral surface of a roller which, in turn, applies the coating composition to the surface of the article to be coated. See, for example, U.S. Pat. Nos. 1,454,362, 1,454,364, and 3,831,553, British Pat. No. 1,388,483, and Item No. 13622, Research Disclosure, August, 1975. Alternatively, the wick can be arranged to come into direct contact with the surface to be coated. See, for example, U.S. Pat. Nos. 1,454,364, 2,348,067, 2,646,770, 3,000,349 and 3,786,736, and British Pat. No. 1,388,483. Wick-type coating apparatus can be used to apply coating compositions to discrete sheets or to continuous webs. Difficulties are often encountered, however, in achieving uniform coating. This is the case both with devices of the type where the wick transfers the coating composition to a roller and of the type where it applies it directly and is especially true in regard to coating a succession of discrete sheets where it is often extremely difficult to obtain highly uniform coatings which are free from skips and streaks. Problems of spillover at the lead and/or trailing edges of a discrete sheet, and resulting unwanted deposition of coating composition on the edges of the sheet, are also commonly encountered.

It is toward the objective of providing a wick-type coating apparatus which is capable of coating both continuous webs and discrete sheets, and of applying liquid coating composition thereto in a highly uniform manner, that the present invention is directed.

SUMMARY OF THE INVENTION

In accordance with the present invention, there is provided a coating apparatus for coating of sheet materials which is capable of providing coatings which are of very low wet coverage, i.e., a very thin coated layer, yet are highly uniform. The apparatus functions by wicking action and utilizes both an absorption wick which serves to receive liquid coating composition from a reservoir and a transfer wick which receives coating composition from the absorption wick and serves to engage the sheet material and apply the coating composition thereto. An important feature of such apparatus is the provision of a transfer wick which, at the end where it engages the sheet material being coated, is free to move relative to the surface of the absorption wick.

More specifically, the coating apparatus of this invention comprises a reservoir for holding liquid coating composition, an absorption wick which is adapted to receive coating composition from the reservoir and which defines an arcuate surface, a transfer wick which is mounted in such manner that it is in conforming contact with the arcuate surface of the absorption wick and is fixedly secured at one end but free at the opposite end to move toward or away from such surface, and means for advancing the sheet material to be coated across and in contact with the end of the transfer wick which is free to move. In operation of the apparatus, liquid coating composition is supplied from a suitable source to the reservoir and passes from the reservoir into the body of the absorption wick and thence into the transfer wick and, finally, onto the surface of the sheet material. In a particular embodiment, the reservoir is a container, such as a slotted cylinder, having an arcuate surface and an opening therein for passage of liquid; the absorption wick is a layer of bibulous material, such as felt, at least partially surrounding the container and covering the opening in the arcuate surface; and the transfer wick is a sheet of fabric disposed in conforming contact with the arcuate surface of the absorption wick, i.e., overlying at least a portion of such surface.

DESCRIPTION OF THE PREFERRED EMBODIMENTS

For convenience of illustration, the coating apparatus of this invention is described hereinafter in reference to the coating of a succession of discrete glass plates of the type employed in the photographic art. It should be appreciated, however, that the coating apparatus is capable of use in a wide variety of different fields and can be adapted to the coating of many different types of sheet material.

Figure 1:
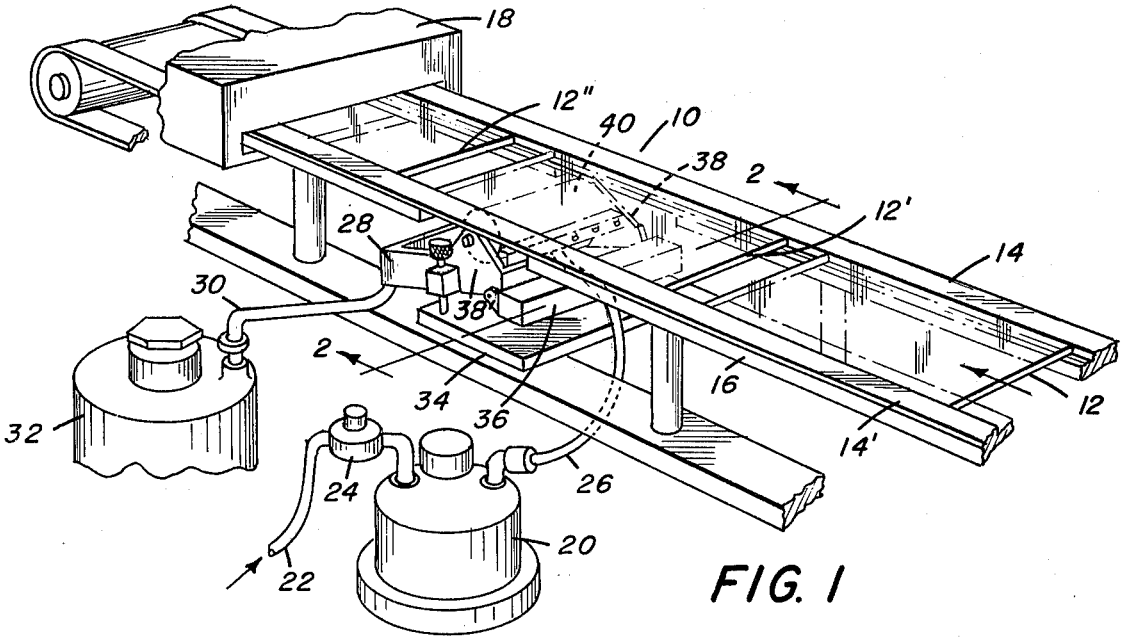
FIG. 1 is a perspective view of a coating hopper and associated conveying and drying apparatus constructed in accordance with this invention.

Referring to FIG. 1, there is shown an apparatus adapted to convey a series of glass plates 12, 12' and 12'' into contact with a coating hopper, indicated generally by the numeral 10, which applies to the surface of each glass plate a layer of liquid coating composition. Plates 12, 12' and 12'' are carried in the direction indicated by the arrow by endless rubber belts 14 and 14' which are supported by framework 16 in such manner that they travel along a horizontal path. Belts 14 and 14' are driven by a suitable motor and speed control system (not shown) at a rate which is dependent on the nature of the coating composition being applied and the desired coating thickness. Plates 12, 12' and 12'' are positioned on belts 14 and 14' so as to leave a short gap between each plate. After receiving a layer of liquid coating composition from coating hopper 10, plates 12, 12′ and 12″ are conveyed through drying chamber 18 in which they are contacted with warm air or other gaseous medium to dry the coating which has been applied. Upon leaving drying chamber 18 the coated plates can be advanced to subsequent coating stations for application of other coated layers or removed from the conveying system and stacked. Liquid coating composition is supplied to coating hopper 10 from supply tank 20 which is connected via hose 22 and pressure regulator 24 to a suitable source of nitrogen or other low pressure gas supply. The gaseous pressure exerted on the liquid coating composition in supply tank 20 forces the coating composition through hose 26 into coating hopper 10. Coating composition is supplied to coating hopper 10 at a constant rate in excess of the rate at which it is coated on the glass plates and the excess coating composition drains into collecting pan 28 and flows from collecting pan 28 via hose 30 into collecting tank 32. Coating composition collected in tank 32 can be discarded or it can be recycled to supply tank 20 by a pump (not shown) or other suitable means. Coating hopper 10 rests on shelf 34 which is supported by framework 16 and includes a base 36 and a stationary cylindrical reservoir 40 which is mounted on raised side wall portions 38 and 30′ of collecting pan 28.

Figure 2:
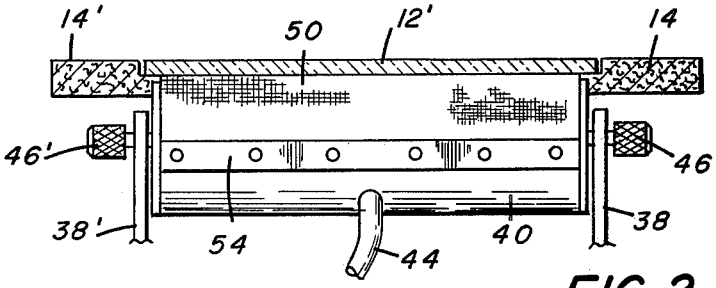
FIG. 2 is a partial cross-section taken substantially along the line 2—2 in FIG. 1.
Figure 3:
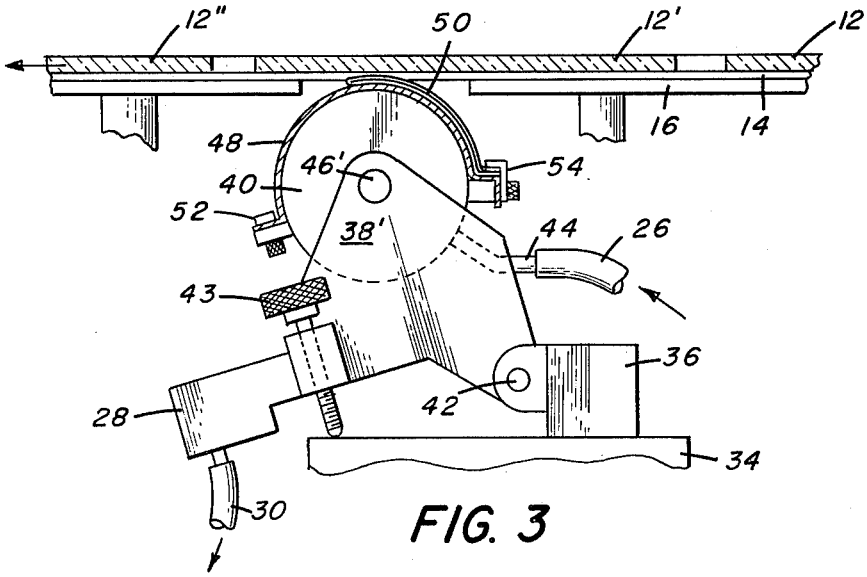
FIG. 3 is a partially sectioned elevaton of the coating hopper.

As shown in FIGS. 2 and 3, collecting pan 28 is pivotally connected to base 36 at pivot point 42 and is equipped with adjusting screw 43 to selectively raise and lower collecting pan 28 and thereby move cylindrical reservoir 40 toward and away from the path along which plates 12, 12′ and 12″ are conveyed. Cylindrical reservoir 40 is fitted with an inlet pipe 44 at its lower midpoint for receiving liquid coating composition and is mounted in raised side wall portions 38 and 38′ by means of screws 46 and 46′. The upper half of the outer surface of cylindrical reservoir 40 is covered with an absorption wick 48 composed of a thick layer of felt and over a portion of absorption wick 48 there is disposed, in contiguous conforming contact, transfer wick 50 composed of a sheet of cotton fabric. Wick 48 is attached to cylindrical reservoir 40 at one end by clamping bar 52 and at the other end by clamping bar 54 which also serves to secure one end of wick 50. Plates 12, 12′ and 12″ rest within indented edge portions of endless belts 14 and 14′ and are carried by such belts into contact with transfer wick 50 which applies a layer of coating composition thereto.

Figure 4:
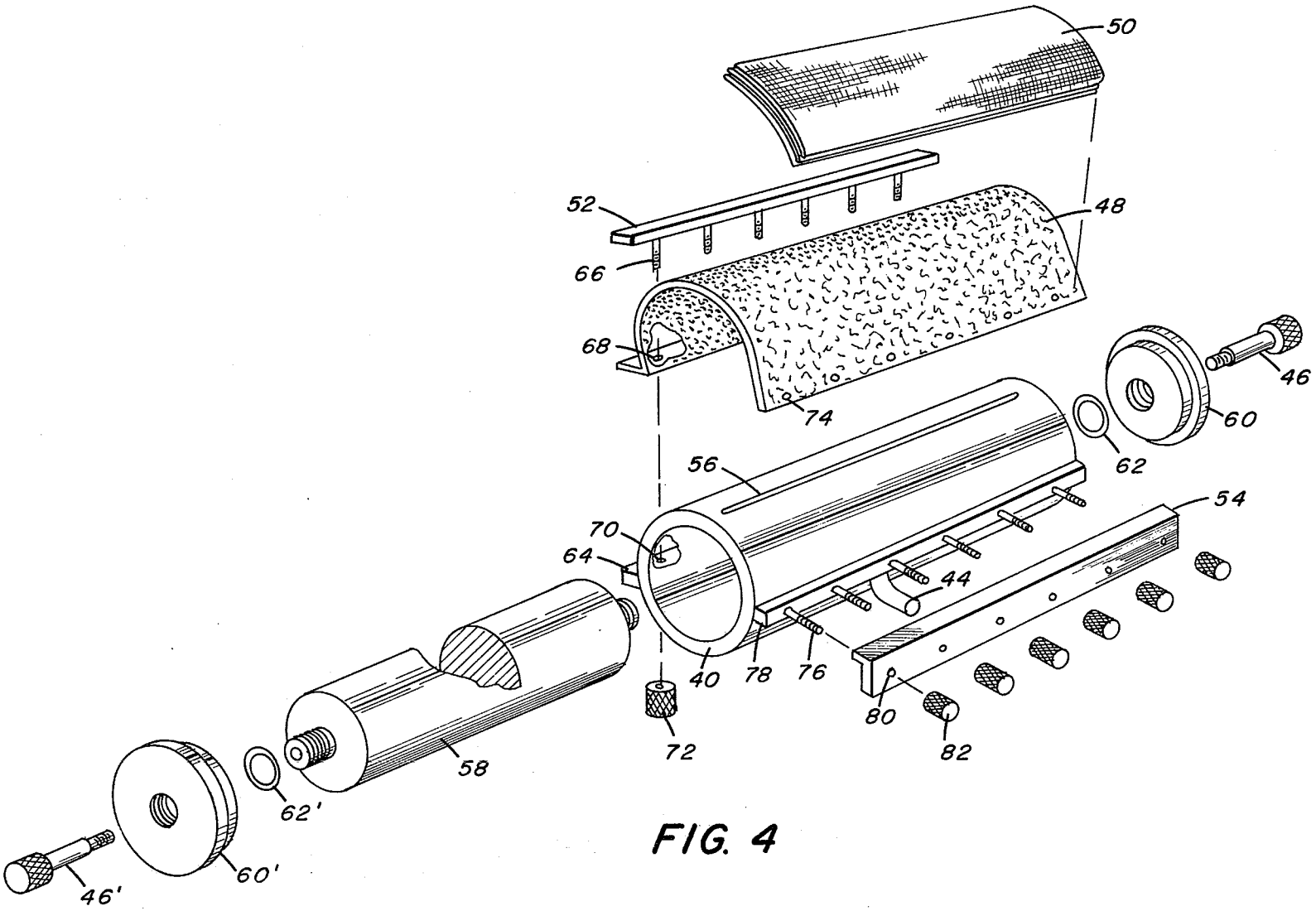
FIG. 4 is an exploded perspective of part of the coating hopper.

As illustrated in FIG. 4, stationary cylindrical reservoir 40 is provided with a narrow slot 56 extending over substantially its full length, an is adapted to receive liquid distributing cylinder 58 which is held in place by end caps 60 and 60′ secured to cylinder 58 by screws 46 and 46′. End caps 60 and 60′ fit into reservoir 40 and serve to close the ends thereof in a liquid tight manner. At the ends of cylinder 58 O-rings 62 and 62′ are provided to ensure that liquid tight sealing is maintained. Liquid coating composition is supplied to reservoir 40 by inlet pipe 44 and flows into the annular region between the external surface of cylinder 58 and the internal surface of reservoir 40. An absorption wick 48, consisting of a thick felt sheet adapted to conform to the upper half of the cylindrical surface of reservoir 40 and completely cover slot 56, is secured to reservoir 40 at one side thereof by means of flange 64 which mates with clamping bar 52. A series of threaded rods 66 on clamping bar 52 are positioned to mate with a series of holes 68 in wick 48 and pass through corresponding holes 70 in flange 64. Caps 72 are screwed on rods 66 to hold clamping bar 52 tightly against wick 48 so that wick 48 is gripped at one end thereof between clamping bar 52 and flange 64. The opposite end of wick 48 is provided with a series of holes 74 adapted to receive threaded rods 76 which are secured to flange 78 and mate with holes 80 in clamping bar 54. Caps 82 are screwed on rods 76 in order to hold clamping bar 54 in position and securely grip the end of wick 48 between clamping bar 54 and flange 78. A transfer wick 50, consisting of a sheet of finely woven cotton fabric folded over to form five layers, is arranged to engage a portion of the surface of wick 48, with one end of wick 50 being gripped between clamping bar 54 and wick 48 and the other end of wick 50 being located in proximity to slot 56 and being free to move toward and away from the arcuate surface of wick 48.

Figure 5:
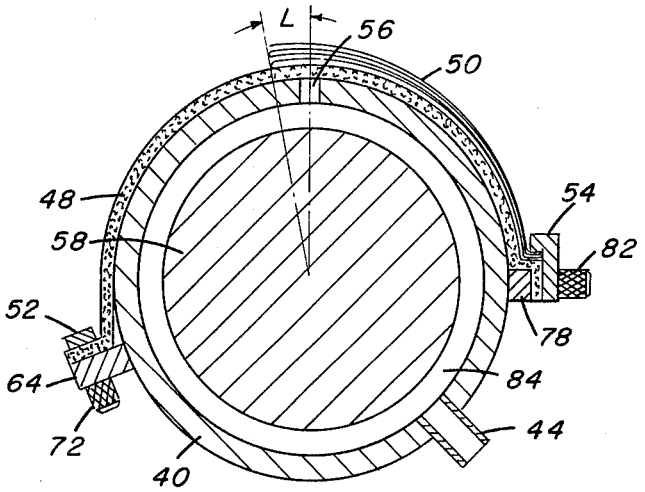
FIG. 5 is a cross-section taken through the midpoint of the assembled apparatus of FIG. 4.

Referring to FIG. 5, it will be seen that liquid coating composition entering reservoir 40 through inlet pipe 44 will flow into and fill annular chamber 84 and pass through slot 56 into the body of wick 48. Wick 48 will become impregnated with liquid coating composition and will supply such composition to wick 50 which is adapted to engage the surface of the sheet material to be coated and will, in turn, transfer the liquid coating composition to such sheet material. A suitable degree of gaseous pressure is applied to force the liquid coating composition into reservoir 40 at a rate appropriate to supply adequate coating composition to wick 50. Coating composition in excess of that which is applied to the sheet material drains from wick 48 and is recovered for subsequent reuse or is discarded.

The coating apparatus of this invention is useful for the coating of a wide variety of different materials, including the coating of continuous webs and the coating of sheet materials in discrete sheet form. It is especially useful in the coating of photographic glass plates. As is well known in the photographic field, photographic plates with glass substrates are widely utilized in applications that require excellent dimensional stability, flatness and rigidity. The coating of photographic glass plates is a very exacting coating operation in view of the stringent requirements that such plates must be capable of meeting. Thus, for example, to be used successfully for the coating of photographic glass plates the coating process must provide (1) complete coverage of the area which is to be coated, i.e., freedom from "skips" which would result in uncoated areas of even miniscule dimensions, (2) a coated layer which is extremely thin, (3) exactly uniform wet coverage, (4) freedom from coated material on the edges of the plate, (5) freedom from streaks or other coating defects, and (6) freedom from contamination with dust or other foreign materials. In addition the process must be capable of handling fragile sheets of glass without damage. The method of this invention effectively meets all of these criteria and is especially well adapted to the exacting requirements involved in the manufacture of photographic glass plates. Typically, such plates include a radiation-sensitive photographic emulsion layer and a subbing layer on one side thereof and an anti-halation layer on the opposite side and the method of this invention is especially useful in applying the coating composition used to form the anti-halation layer. Coating compositions used to form anti-halation layers typically comprise a solvent solution of a light-absorbing dye and are compositions of relatively low viscosity.

The coating apparatus described herein can be employed with any liquid coating composition that is capable of application by wicking action. Especially good results are obtained with low viscosity coating compositions, for example, those having a viscosity in the range from about three to about 24 centipoises and more preferably in the range from about 8 to about 16 centipoises.

The particular embodiment of the invention which is illustrated in the drawings and described in detail herein employs a slotted cylinder as the reservoir for the liquid coating composition. However, the specific design of the reservoir is not important and any type of reservoir capable of providing a relatively uniform flow of liquid coating composition to an absorption wick can be employed. In using a cylindrical reservoir, a slot provides a particularly effective means of uniformly feeding the liquid to the absorption wick but other types of construction can also be employed, for example, a series of small holes extending along the length of the cylinder in place of the slot. With either the slotted cylinder or a cylinder provided with a series of holes, the use of a liquid distributing cylinder within the reservoir is optional but is usually advantageous. Thus, for example, the liquid distributing cylinder serves to aid in providing uniform discharge of the coating composition from the slot or series of holes. It also serves to reduce the total volume within the reservoir and confine the coating composition to a thin annular region and thereby to reduce the tendency for dried residue from the coating composition to build up in the reservoir, particularly when using compositions containing relatively volatile solvents such as are used in coating compositions for forming anti-halation layers on photographic glass plates.

Liquid coating composition is conveniently supplied to the reservoir from a pressurized container using gaseous pressure, such as a low pressure nitrogen system, to control the flow rate. However, many other types of liquid supply systems, such as a constant rate pump or a gravity fed system employing a constant head of liquid, can also be employed. The coating apparatus is typically operated as a constant flow system with more coating composition being supplied to the absorption wick than is used in coating so that the excess coating composition drains from the outer surface of the coating hopper and is collected in a suitable container located under the hopper and either disposed of or recycled to the supply system. This method of coating is advantageous in maintaining the absorption wick completely soaked with coating composition at all times and thereby greatly reducing the tendency for dried residues to form. It is particularly desirable in applying coating compositions which contain volatile solvents and, accordingly, are prone to dry out. It has the further advantage that particulate contaminants tend to be flushed away rather than remain in the coating region.

A pressure-fed, horizontally-disposed slotted cylinder, such as is illustrated herein, functions in a manner which forms a "standing wave" of coating composition and thus the coating apparatus described herein combines the principles of standing wave coating systems (see for example U.S. Pat. No. 1,929,877) and wick coating systems. A standing wave coating system is generally capable of providing fairly good coating uniformity but is not well adapted to the application of very low wet coverages of coating composition and, if used to coat a series of discrete sheets, tends to suffer from the fact that lead and trail edge spillover of coating composition is likely to occur. On the other hand, the wick coating systems of the prior art will usually provide low wet coverage but generally provide poor results in regard to overall uniformity of coating and are often unsatisfactory with respect to control of lead and trail edge spillover. With the apparatus of this invention, the combination of standing wave and wick coating principles provides excellent uniformity, little or no edge spillover, and the capability to coat a layer of very low wet coverage.

The absorption wick can be constructed from any of a variety of bibulous materials. It should be highly absorptive of liquids since it serves, in effect, as a liquid reservoir for the transfer wick which, in turn, serves to distribute the liquid coating composition onto the surface of the sheet material being coated. An example of a particularly effective material for the absorption wick is felt. The felt can be a wool felt or a cotton felt or composed of a mixture of wool with cotton or with synthetic fibers. Examples of other useful materials for the absorption wick include flannel, fiberglass, sponge rubber, polyurethane foam, and the like. The absorption wick can be of any suitable geometric configuration adapted to provide an arcuate surface which supports the transfer wick and maintains it in a suitable orientation, for example a configuration adapted in the preferred embodiment of the invention to tangential approach of the sheet material being coated.

The transfer wick can be constructed from any of a variety of materials suitable for applying a liquid coating composition to the surface of sheet materials. Suitable materials for the transfer wick are those which will readily take up the liquid coating composition from the absorption wick and convey it to the coating point and are flexible enough to readily conform to the arcuate surface of the absorption wick. Materials which are not adversely affected by the coating composition and not easily abraded are particularly desirable. Examples of useful materials for the transfer wick include woven and non-woven fabrics composed of natural or synthetic fibers or of blends of natural and synthetic fibers. Finely woven fabrics are especially useful, particularly finely woven cotton fabric. While the transfer wick can be composed of a single layer of fabric, it is especially preferred that the transfer wick be formed from a sheet of fabric which has been folded over upon itself several times in such manner that one end of the sheet is located at the top of the fold. This is illustrated by FIGS. 3 to 7 herein which show a transfer wick which has been folded to form five layers of fabric. The free end of the folded sheet of fabric acts to provide the contact with the moving sheet material. Advantageously, the free end of the transfer wick will be a closed weave section since if there are strands of thread at the free end, such as could result from cutting across a sheet of fabric, fibers can be pulled out and embedded in the coating.

The position of the transfer wick in relation to the slot (or other discharge orifice) in the reservoir is important for best results in coating. Thus, for example, it is particularly preferred that the free end of the transfer wick extend slightly beyond the slot. Most advantageously, the free end of the transfer wick will be in the region extending from 1° to 5° of arc beyond the slot. Thus, for example, in FIG. 5 the distance L is preferably in a range such that the angle from the vertical defined of a line passing through the end of the transfer wick and intersecting the midpoint of the reservoir is in the range of one to five degrees. Setting the transfer wick so that this angle is over 5° can result in a pulling action on the transfer wick as the sheet material passes by, with a resulting tendency to cause coating non-uniformities. On the other hand, setting the transfer wick so that this angle is less than 1° can also produce variations in coating uniformity as well as coating skips. The spacing between the coating hopper and the lower surface of the sheet material being coated should be adjusted to take into account the geometry of the apparatus, e.g., the degree of curvature of the arcuate surface, the type of coating composition being utilized, and the location of the free end of the transfer wick. A short transfer wick, such as one where the aforesaid angle is 1°, requires a greater spacing than a longer transfer wick, such as one where the aforesaid angle is 5°, in order to supply an adequate quantity of liquid coating composition. If the transfer wick is too short so that the spacing between the coating hopper and sheet material must be made too great, there is a tendency for lead and trail edge spillover to occur; whereas if the transfer wick is too long the coating hopper must be tight to the surface of the sheet material and in such circumstances variation in the density of the coated layer applied can occur due to pulling of the wick.

Sheet material to be coated can be brought into position for coating by means of any suitable conveying system adapted to convey the sheet material across and in contact with the free end of the transfer wick; the sheet material typically being advanced in a direction tangential to the arcuate surface of the absorption wick into contact with the free end of the transfer wick. For example, continuous webs can be conveyed by means of a suitable arrangement of drive rolls and guide rolls; while series of discrete sheets can be conveyed by resilient rollers which engage the faces or edges of each sheet. In coating of photographic glass plates, particularly good results are obtained with the use of a pair of endless belts composed of rubber or other resilient material, each of such belts being equipped with a narrow indented edge portion on which the edge of the glass plate is permitted to rest. This permits the plate to be brought into contact with the coating apparatus while keeping contact with the face of the plate to a minimum. Preferably, the endless belts should be so positioned and arranged that the glass plates are conveyed in a substantially horizontal plane so as to facilitate the accomplishment of precisely uniform coating.

The speed at which coating is carried out can be widely varied and the optimum speed will depend upon a variety of factors such as whether a continuous web or a succession of discrete sheets is being coated, the particular type of sheet material being coated, the viscosity of the coating composition, the desired coating thickness, and so forth. In the application of anti-halation layers to photographic glass plates, good results are obtained at speeds from about 5 feet per minute to about 25 feet per minute. If the glass plate is held in position only by its own weight, speeds in excess of 25 feet per minute tend to cause streaks and skips in the coating. However, if the glass plates are held by a roller, or other hold-down device, substantially greater speeds can be utilized.

The apparatus of this invention functions to apply the coating composition to the surface of the sheet material by the formation of a "coating bead". In this method of coating, there is a "pile up" or "puddle" of coating composition, which extends across the full width of sheet material being coated, that is commonly referred to as a "bead" of coating composition. Coating composition is supplied to the "bead" from the transfer wick and withdrawn from the "bead" by the surface of the moving support. Thus, the coating is not deposited directly onto the support surface by the transfer wick but rather the transfer wick functions to maintain the "bead" and the support surface is coated therefrom. The thickness of the coating composition applied to the support surface is determined by the action of the "bead" and varies with such factors as the rate at which coating composition is supplied to the transfer wick and the speed at which the support is advanced.

Figure 6:
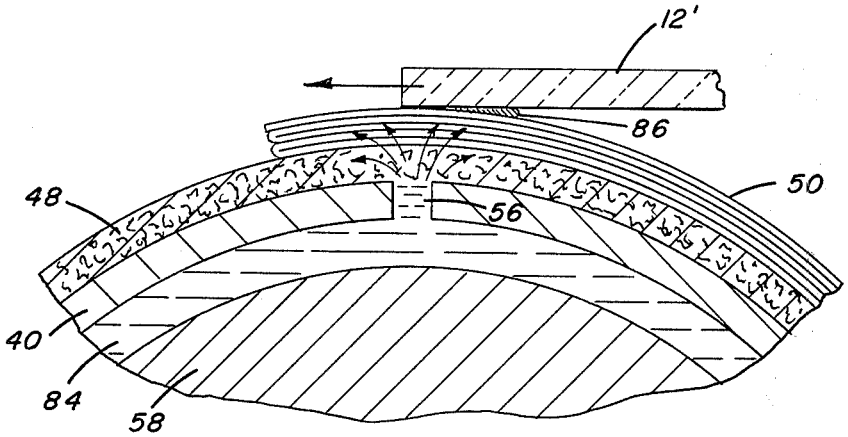
FIG. 6 is a partial cross-section of the apparatus of FIG. 4 illustrating the formation of a "coating bead" upon initial contact of a sheet material with the coating apparatus.

FIG. 6 illustrates conditions where glass plate 12' has made contact with transfer wick 50 and has reached the point where the leading edge of plate 12' is proximate to slot 56. The arrows indicate that liquid coating composition is flowing from annular chamber 84 through slot 56 into absorption wick 48 and then into transfer wick 50. A "bead" of coating composition 86 is shown in the region between plate 12' and transfer wick 50.

Figure 7:
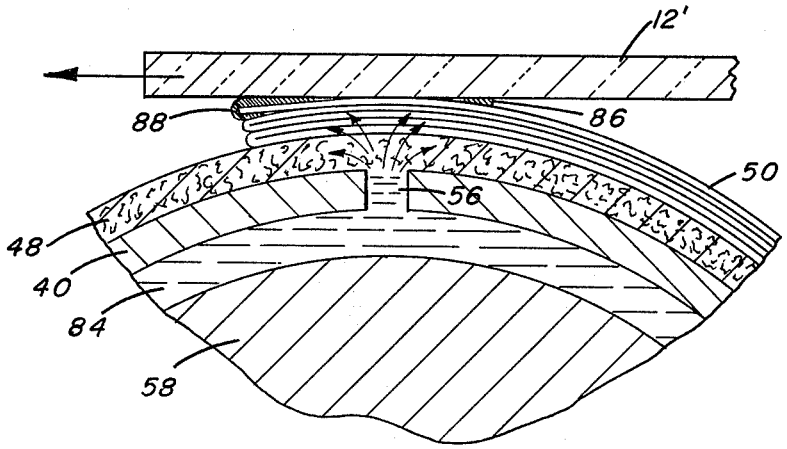
FIG. 7 is a partial cross-section of the apparatus of FIG. 4 illustrating the formation of a second "coating bead" as the sheet material moves across the coating apparatus.

FIG. 7 illustrates conditions where plate 12' has advanced to a point where the leading edge thereof is beyond the end of transfer wick 50. A first "bead" of coating composition 86 is shown in the region between plate 12' and transfer wick 50 at one side of slot 56 and a second "bead" of coating composition 88 is shown in the region between plate 12' and transfer wick 50 at the opposite side of slot 56. Coating bead 88 functions in such manner as to lift the free end of transfer wick 50 and force it towards the bottom surface of plate 12'.

The manner whereby the coating apparatus of this invention operates is dependent upon whether the material being coated is in the form of a continuous web or in the form of a series of discrete and separate sheets. If a continuous web is coated, coating beads 86 and 88 are formed upon start-up and are maintained throughout the coating operation. On the other hand, when the material being coated consists of a series of discrete sheets which are separated from one another, coating beads 86 and 88 are "broken" as the sheet material passes out of contact with transfer wick 50, thereby allowing the free end of transfer wick 50 to fall back into contact with absorption wick 48, and are reformed as the next sheet of material in the series comes into contact with transfer wick 50. The repeated forming, breaking and reforming of the coating beads in sequence with the arrival and departure of the discrete sheets provides uniform coating of each of the series of sheet materials.

The spacing maintained between discrete sheets of material being coated can be varied over a substantial range. However, it is important for best results that such spacing not be too small nor too great. Thus, the spacing should be sufficient to allow adequate time for the coating beads to be broken and to reform. On the other hand, if too large a spacing is provided, problems with respect to non-uniformity of coating can be encountered since each separate sheet of material becomes, in effect, comparable to a new "start-up" of the coating apparatus. The optimum spacing between discrete sheets of material to be coated will vary with a number of factors, such as the speed at which the sheets are advanced, the viscosity of the coating composition, and the pressure under which the coating composition is supplied, and can be readily determined in a given instance by a few simple experiments.

Coating apparatus as described herein was used to apply an anti-halation coating to photographic glass plates. The apparatus was comprised of a pressure-fed, stainless steel, slotted cylinder 1¾ inches in diameter having a slot with a width of 1/32 inch and equipped with a distributing cylinder held in place by end caps. The absorption wick consisted of a ¼ inch thick sheet of felt (40% wool and 60% cotton) covering the upper 180° of the slotted cylinder and the transfer wick consisted of a finely woven 100% cotton fabric folded to form five layers and positioned so that the free end thereof extended approximately 5° beyond the slot and the region of contact between the transfer wick and the glass plates was about ½ inch in length. Liquid coating composition having a viscosity of 10 centipoises at 20° C was fed to the coating hopper at a constant rate using a constant nitrogen pressure of 1¼ psi on the liquid supply. Under such conditions, for each part by weight of solution coated on the glass plates two parts by weight were collected in the collection pan. Photographic glass plates 18 inches in length and 6 inches in width, were conveyed by endless belts at a speed of 15 feet per minute and were positioned on the conveying belts with a space of 1 inch between successive plates. The apparatus functioned effectively to provide a thin uniform coating of the liquid composition without edge spillover and without streaks or other coating defects.

The invention has been described in detail with particular reference to preferred embodiments thereof, but it will be understood that variations and modifications can be effected within the spirit and scope of the invention.

I claim:

1. A coating apparatus for coating sheet material with a liquid coating composition, said apparatus comprising 1. a reservoir for holding said liquid coating composition;
2. an absorption wick in communication with said reservoir to receive coating composition therefrom, said absorption wick having an arcuate surface;
3. a transfer wick in conforming contact with the arcuate surface of said absorption wick to receive coating composition therefrom, one end of said transfer wick being free to move toward and away from said arcuate surface; and
4. means for advancing the sheet material to be coated across and in contact with the end of said transfer wick which is free to move to apply a uniform layer of said coating composition to the surface of said sheet material.

2. Coating apparatus as defined in claim 1 wherein said reservoir is a cylinder having a longitudinal slot therein to permit passage of said liquid coating composition into said absorption wick.

3. Coating apparatus as defined in claim 2 additionally comprising a liquid distributing cylinder positioned within said slotted cylinder to form an annular chamber for said liquid coating composition.

4. Coating apparatus as defined in claim 1 wherein said absorption wick is composed of felt.

5. Coating apparatus as defined in claim 2 wherein said absorption wick consists of a layer of felt partially surrounding the cylindrical outer surface of said slotted cylinder and covering said slot.

6. Coating apparatus as defined in claim 1 wherein said transfer wick is composed of finely woven fabric.

7. Coating apparatus as defined in claim 1 wherein said transfer wick is composed of finely woven cotton fabric.

8. Coating apparatus as defined in claim 2 wherein said transfer wick consists of a sheet of finely woven fabric which has been folded over upon itself several times and in which the free end thereof is located in proximity to said slot.

9. Apparatus for usein the coating of sheet material with a liquid coating composition, said apparatus comprising 1. a reservoir for holding said liquid coating composition;
2. an absorption wick in communication with said reservoir to receive coating composition therefrom, said absorption wick having an arcuate surface; and
3. a transfer wick in conforming contact with the arcuate surface of said absorption wick to receive coating composition therefrom, said transfer wick being free at one end thereof to move toward and away from said arcuate surface and said free end being positioned to contact the surface of the sheet material to be coated.

10. Apparatus as defined in claim 9 wherein said reservoir is a cylinder having a longitudinal slot in the cylindrical surface thereof, said absorption wick is a layer of felt partially surrounding the cylindrical surface of said cylinder and covering said slot, and said transfer wick is a sheet of fabric overlying a portion of the surface of said layer of felt which is fixed at one end and has a free end located in proximity to said slot.

11. A coating apparatus for coating sheet material with a liquid coating composition, said apparatus comprising 1. a reservoir for holding liquid coating composition;
2. a body of bibulous material in communication with said reservoir to receive coating composition therefrom, said body having an arcuate surface;
3. a sheet of fabric in conforming contact with the arcuate surface of said body of bibulous material to receive coating composition therefrom, said sheet of fabric being fixedly held at one end thereof and free at the opposite end thereof to move toward and away from said arcuate surface; and
4. means for advancing the sheet material to be coated in a direction tangential to said arcuate surface into contact with the end of said sheet of fabric which is free to move to apply a uniform layer of said coating composition to the surface of said sheet material.

12. A coating apparatus for coating sheet material with a liquid coating composition, said apparatus comprising 1. a frame;
2. a hollow cylinder supported by said frame having an inlet for receiving liquid coating composition and a longitudinal slot in the cylindrical surface thereof;
3. a supply tank for liquid coating composition connected to the inlet of said hollow cylinder;
4. a collecting pan for receiving excess liquid coating composition from said hollow cylinder, said collecting pan being supported by said frame and located directly beneath said hollow cylinder;

5. a layer of bibulous material partially surrounding the cylindrical outer surface of said hollow cylinder and covering said slot;
6. a sheet of fabric directly contiguous to said layer of bibulous material having one end fixedly secured and the opposite end free to move toward and away from said layer of bibulous material; the free end of said sheet of fabric being located proximate to said slot; and
7. means for advancing the sheet material to be coated in a direction tangential to the surface of said hollow cylinder into contact with the end of said sheet of fabric which is free to move to apply a uniform layer of said coating composition to the surface of said sheet material.

13. Coating apparatus as defined in claim 12 wherein said layer of bibulous material is a sheet of felt and said sheet of fabric is a finely woven cotton fabric which has been folded over upon itself several times.

14. Coating apparatus as defined in claim 13 additionally comprising a liquid distributing cylinder positioned within said slotted cylinder to form an annular chamber for said liquid coating composition.

15. Coating apparatus as defined in claim 13 additionally comprising means for raising and lowering said hollow cylinder in relation to the path along which said sheet material is advanced.

16. Coating apparatus as defined in claim 12 wherein said means for advancing the sheet material comprises a pair of endless belts adapted to support said sheet material.

17. A coating apparatus for coating photographic glass plates with liquid anti-halation coating composition, said apparatus comprising 1. a hollow cylinder having an inlet for receiving the liquid anti-halation coating composition and a longitudinal slot in the cylindrical surface thereof;
2. a liquid distributing cylinder positioned within said slotted cylinder to form an annular chamber for said liquid anti-halation coating composition;
3. a layer of felt partially surrounding the cylindrical outer surface of said hollow cylinder and covering said slot;
4. a sheet of cotton fabric folded over upon itself to form five layers of fabric arranged in conforming contact with said layer of felt and positioned so that one end thereof is proximate to said slot;
5. a first clamping bar adapted to secure one end of said layer of felt in contact with the cylindrical surface of said hollow cylinder;
6. a second clamping bar adapted to hold a second end of said layer of felt in contact with the cylindrical surface of said hollow cylinder and to grip the end of said sheet of fabric which is remote from said slot and hold it against said layer of felt;
7. a liquid supply tank for anti-halation coating composition connected to the inlet to said hollow cylinder;
8. a gas supply connected to said liquid supply tank for exerting gaseous pressure on the liquid anti-halation coating composition contained therein;
9. a frame;
10. a pair of endless belts composed of a resilient material, each of said belts having an indented edge portion upon which an edge of each of a series of said photographic glass plates is adapted to rest and being supported by said frame for travel in a horizontal direction;
11. means for advancing said endless belts at a desired speed;
12. a collecting pan supported by said frame for receiving excess liquid anti-halation coating composition from said layer of felt;
13. means for mounting said hollow cylinder within said collecting pan at a position immediately beneath the path along which said glass plates are conveyed; and
14. a levelling screw connected to said collecting pan for raising and lowering said pan and thereby raising and lowering said hollow cylinder with respect to the path along which said glass plates are advanced; whereby liquid anti-halation coating composition is forced by said gaseous pressure from said liquid supply tank into said hollow cylinder and from said hollow cylinder into said layer of felt and then into said sheet of cotton fabric from which it is applied to the surface of each of said photographic glass plates.

* * * * *